US005918352A

United States Patent [19]

Galbreath

[11] Patent Number: 5,918,352

[45] Date of Patent: Jul. 6, 1999

[54] DEVICE TO CONTAIN SHOELACE KNOT AND LACE ENDS

[76] Inventor: John A. Galbreath, 6 Smoke Rise La., Bedminster, N.J. 07921

[21] Appl. No.: 09/110,752

[22] Filed: Jul. 3, 1998

[51] Int. Cl.[6] ..... F16G 11/00

[52] U.S. Cl. ..... 24/712.3; 24/712.1; 24/712.6; 24/713.6

[58] Field of Search ..... 24/712.3, 712.2, 24/712.1, 712, 712.6, 712.9, 713.6, 715.3, 633, 590; 36/50.1

[56] References Cited

U.S. PATENT DOCUMENTS

| | | | |
|---|---|---|---|
| D. 275,336 | 9/1984 | Herdman | D2/316 |
| 948,460 | 2/1910 | Partridge | 24/712.6 |
| 2,841,849 | 7/1958 | Rice et al. | 24/712.3 |
| 3,106,003 | 10/1963 | Herdman | 24/712.3 |
| 3,122,805 | 3/1964 | Hakim | 24/119 |
| 3,132,394 | 5/1964 | Russell | 24/119 |
| 3,176,362 | 4/1965 | Tames | 24/712.6 |
| 3,229,340 | 1/1966 | Herdman | 24/119 |
| 3,321,815 | 5/1967 | Herdman | 24/119 |
| 3,422,977 | 1/1969 | Shaw | 24/590 |
| 3,908,238 | 9/1975 | Panicci | 24/119 |
| 4,426,756 | 1/1984 | Herdman | 24/119 |
| 4,485,529 | 12/1984 | Blum | 24/117 |
| 4,715,094 | 12/1987 | Herdman | 24/119 |
| 4,969,242 | 11/1990 | Carlton, Sr. | 24/712.3 |
| 4,999,888 | 3/1991 | Miller | 24/712.3 |
| 5,022,127 | 6/1991 | Ang | 24/712.2 |
| 5,722,132 | 3/1998 | Jones | 24/712.2 |

*Primary Examiner*—Victor N. Sakran

[57] ABSTRACT

My invention is a device for preventing children from untying their shoelaces. It can be quickly and easily installed and removed by adults of any age.

A snap-fit cap, attached to a well, forms the main body of the device. To install, the device (in an open position) is slipped between the knot and the shoe, using a slot incorporated into the well.

The knot and lace ends are placed into the well, and the cap is then fitted over the well, to securely contain the knot and lace ends and prevent removal. The cap may only (and then may easily) be removed when a indicator tab on the cap is aligned with the slot in the well.

Removal is basically the reverse of installation, except that the cap is rotated to line up its indicator tab with the slot in the main body of the device. The cap may then simply pulled off in one quick, easy motion. The device is then slipped off the shoe and laces.

There are several advantages of this invention over the prior art. First, its simple design makes it quick and easy for an adult of any age to install and remove. Second, the invention is also more difficult for a child to remove than prior art—an adult can quickly snap the cap on or off, minimizing the time children have to observe and learn the cap's principles of operation. Third, the invention may be manufactured in one piece if desired, thus minimizing manufacturing steps and cost.

17 Claims, 12 Drawing Sheets

DEVICE TO CONTAIN SHOELACE KNOT AND LACE ENDS

BACKGROUND—CROSS-REFERENCES TO RELATED APPLICATIONS

Not applicable; omitted.

BACKGROUND—FIELD OF INVENTION

This invention is in the area of shoe and shoelace products, specifically an improved device to contain shoelace knots and lace ends, and prevent them from being untied.

BACKGROUND—DISCUSSION OF PRIOR ART

As soon as they begin using shoes, most children exhibit a fascination with their shoelaces, and a propensity to untie them and then unlace them completely. This is frustrating and time-wasting for adults, and it is also a safety issue, since the removed shoelaces represent a strangulation risk.

Prior art devices are not very effective, however, because they can still be removed by most children. Several examples illustrate: the latching means of U.S. Pat. No. 4,969,242 to Carlton Sr. can easily be comprehended and unlatched by a child. Threaded caps, like those on U.S. Pat. Nos. 3,122,805 to Hakim, 3,229,340 to Herdman, and 4,426,756 to Herdman can also be be comprehended and unscrewed by a child, unless a large amount of torque is applied when screwing on the cap.

Similarly, the devices of U.S. Pat. Nos. 4,485,529 to Blum, 5,022,127 to Ang, and 4,715,094 to Herdman may also be easily defeated by a child, because with those devices, the shoelace loops and ends remain exposed. A device which fully contains the knot and lace ends is preferable, because a child will more likely become disinterested in playing with the laces if they are fully contained and hidden from sight.

Probably the greatest disadvantage of prior art devices is that they are very cumbersome to install and remove, particularly on the foot of a squirming toddler. For example, the devices in U.S. Pat. Nos. 3,321,815 and 4,426,756, both to Herdman, require that an adult stuff the laces into a relatively small compartment, through a small opening. The hard tips of the laces are particularly difficult to insert into the compartment.

Relatedly, prior art devices are also time consuming to install and remove a key disadvantage since a limited amount of time is available before the child begins to turn around, get up, run away, etc. For example, the devices of U.S. Pat. Nos. 3,122,805 to Hakim, 4,969,242 to Carlton Sr., 4,999,888 to Miller, and 5,022,127 to Ang require that the laces be threaded through the device before the laces can be tied. This takes more time and involves a different, more cumbersome knot tying process than well-known, conventional processes. The laces cannot be tied beforehand, either by an adult or a child.

A further disadvantage of prior art devices is that they are difficult to manufacture in one piece, which adds extra assembly steps and cost to the manufacturing process. The devices shown in U.S. Pat. Nos. 3,132,394 to Russell, 3,908,238 to Panicci, 4,426,756 to Herdman, and 4,485,529 to Blum exhibit this disadvantage.

A shoelace containment device that is fast and easy for an adult to install and remove, yet very difficult for children to remove, would be a great improvement over the prior art. Additionally, being able to easily manufacture the device in one piece would minimize manufacturing steps and cost.

OBJECTS AND ADVANTAGES

Accordingly, several objects and advantages of my invention are:

It is easy for an adult to install and remove. Stuffing of laces into a small compartment, through a small opening, is not required.

An adult can quickly install and remove it. This is key, because children will sit still for only a limited amount of time.

An adult of any age can quickly and easily operate the invention. It doesn't present a problem for older people (grandparents, etc.) with arthritis or reduced dexterity—a key advantage over the prior art.

My invention features an offset slot for introducing the knot and lace ends into the compartment. The offset slot positions the device more suitably on the shoe, minimizing interference between the device and the upper areas of the shoe and foot.

My invention features a snap-fit cap which can be operated very quickly, not allowing a child to observe its working principle for very long. My invention is thus more difficult for a child to remove than prior art, and it more effectively performs the task of preventing the untying and removal of laces.

My invention can be easily manufactured in one piece, thereby minimizing manufacturing steps and cost.

Further objects and advantages of my invention will become apparent from a consideration of the drawings and ensuing description.

LIST OF REFERENCE NUMERALS

Figure 1:
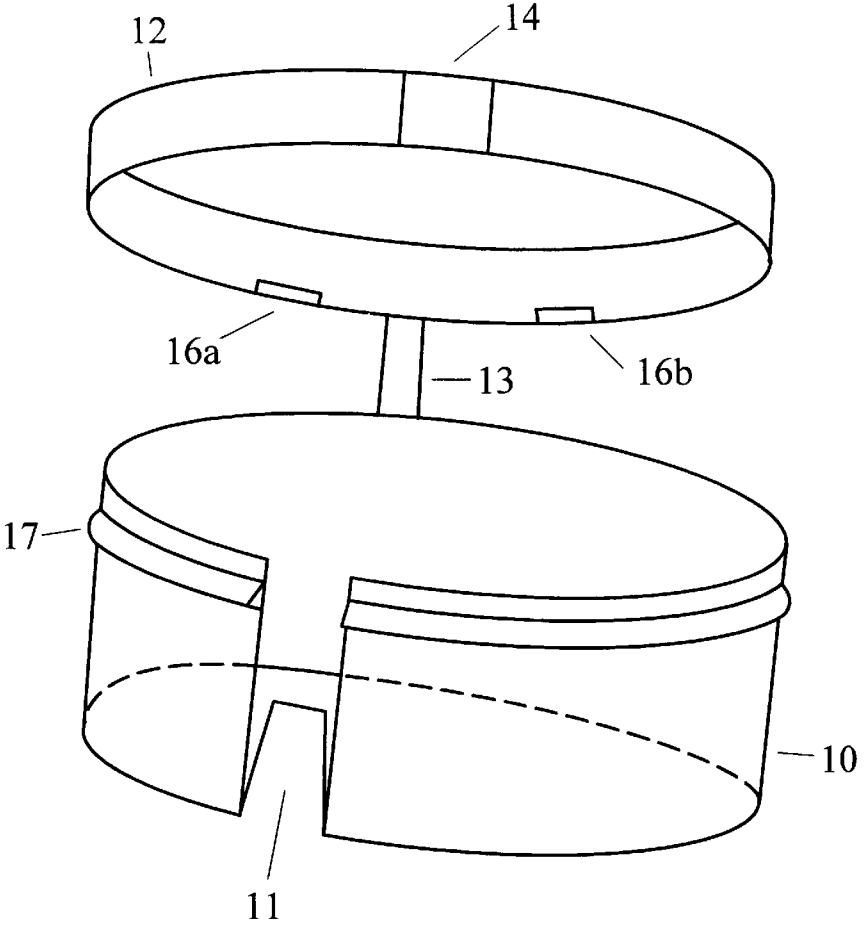
FIG. 1 is a perspective view of my invention in the open position, illustrating its basic construction.

Note: My invention is preferably made in one piece, so there aren't separate parts per se. This list indicates, therefore, the different sections and features of my invention, as labeled in the drawings.

10. Well
11. Slot
12. Cap
13. Strap
14. Indicator tab
15. Projecting tab
16*a&b*. Additional projecting tabs
17. Ridge
18. Notch (alternative embodiment)
19. Notch indicator (alternative embodiment)
20. Central member (alternative embodiment)
21*a&b*. Slots (alternative embodiment)
22. Shelf (alternative embodiment)

SUMMARY

My invention is a more effective device for preventing children from untying and removing their shoelaces. The device can be installed and removed much more easily and quickly than prior art.

DESCRIPTION—MAIN EMBODIMENT

FIG. 1 is a perspective view of my invention, showing its basic construction. A circular well 10, sufficiently large to contain the knot and shoelace ends, forms the main body of the device.

Figure 6:
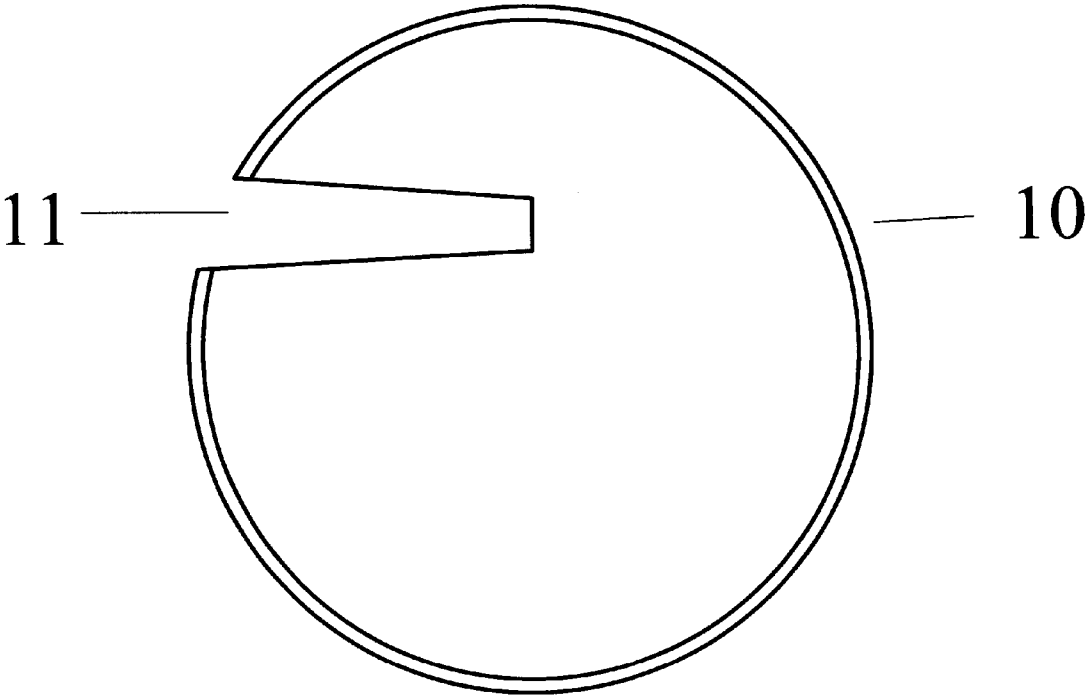
FIG. 6 is a top view of the well, providing additional detail on the offset slot.

As detailed in FIG. 6, an offset slot 11 is incorporated into well 10, creating an opening through which the knot and shoelace ends are slipped into the device. The offset nature of slot 11 improves the fit of the device on the shoe by minimizing interference between the device and the upper areas of the shoe and foot. Slot 11 narrows toward the interior of well 10, to grip the knot and laces more tightly and increase the stability of the device atop the shoe.

Figure 5:
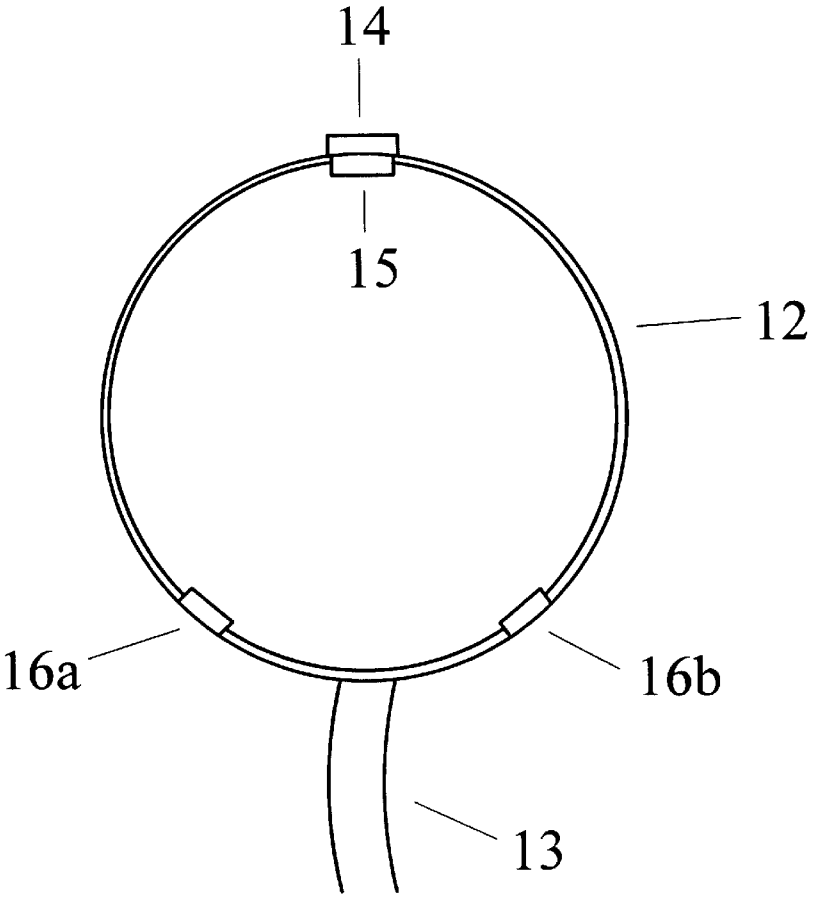
FIG. 5 provides additional detail on the snap-fit cap.

As detailed in FIG. 5, a round, snap-fit cap 12 is attached to well 10 by a strap 13. Cap 12 has a indicator tab 14 located on its outside circumference opposite from strap 13, and a corresponding projecting tab 15 located on its inner circumference, also opposite from strap 13. Cap 12 has two additional projecting tabs 16*a&b* located on its inner circumference close to, but spaced apart from, strap 13, to aid in retaining cap 12 on well 10.

A raised ridge 17 is located around the circumference of well 10. Ridge 17 does not extend fully around the circumference of said well 10; rather, slot 11 interrupts ridge 17, such that cap 12 can be easily removed from well 10 when projecting tab 15 is aligned with slot 11.

Strap 13 is located on well 10 such that when cap 12 is in a installed, untwisted position, indicator tab 15 and projecting tab 15 will not be aligned with slot 11. Strap 13 is of sufficient length and resilience to allow cap 12 to rotate to align projecting tab 15 with slot 11.

The inside circumference of cap 12, except for projecting tab 15 and projecting tabs 16*a&b,* is approximately equal to the outside circumference of ridge 17. Cap 12 thus substantially fits over ridge 17, except for projecting tab 15 and projecting tabs 16*a&b,* which must snap over ridge 17, locking cap 12 into place over well 10.

The device is preferably constructed in one piece, with cap 12 and strap 13 being integrally constructed and attached to the main body of the device.

OPERATION—MAIN EMBODIMENT

Figure 2:
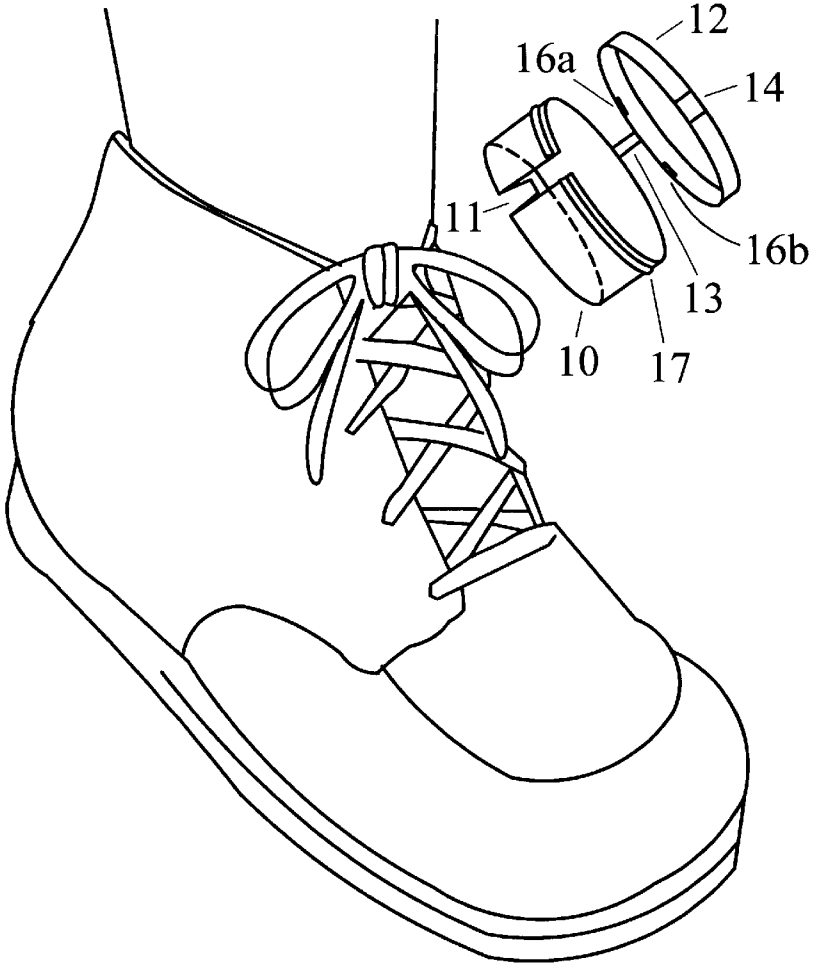
FIG. 2 shows the device, in an open position, being inserted onto the shoe.
Figure 3:
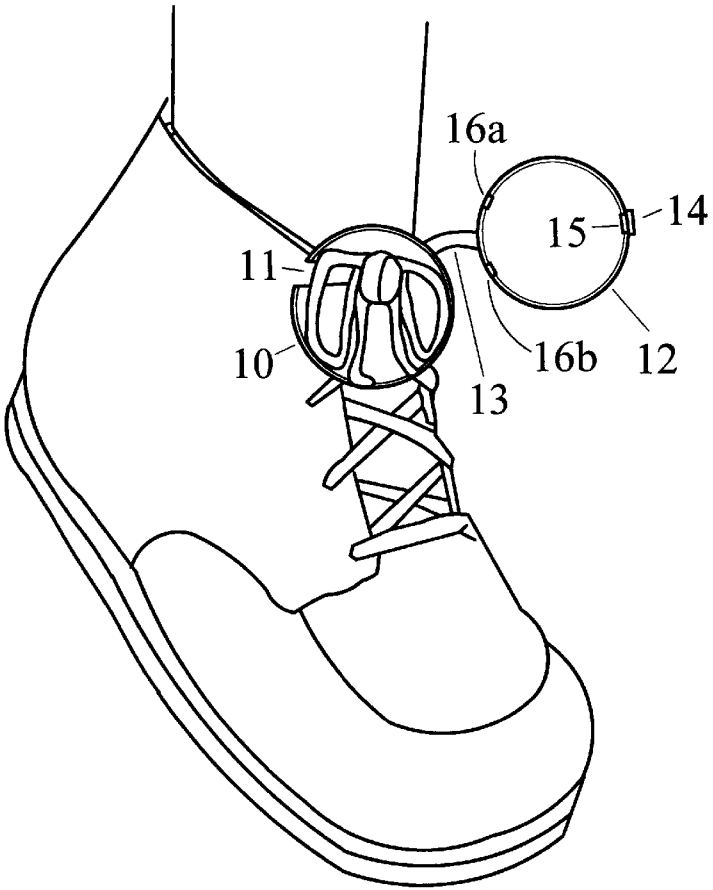
FIG. 3 shows the device, in an open position atop the shoe, with the knot and lace ends inside the well.
Figure 4:
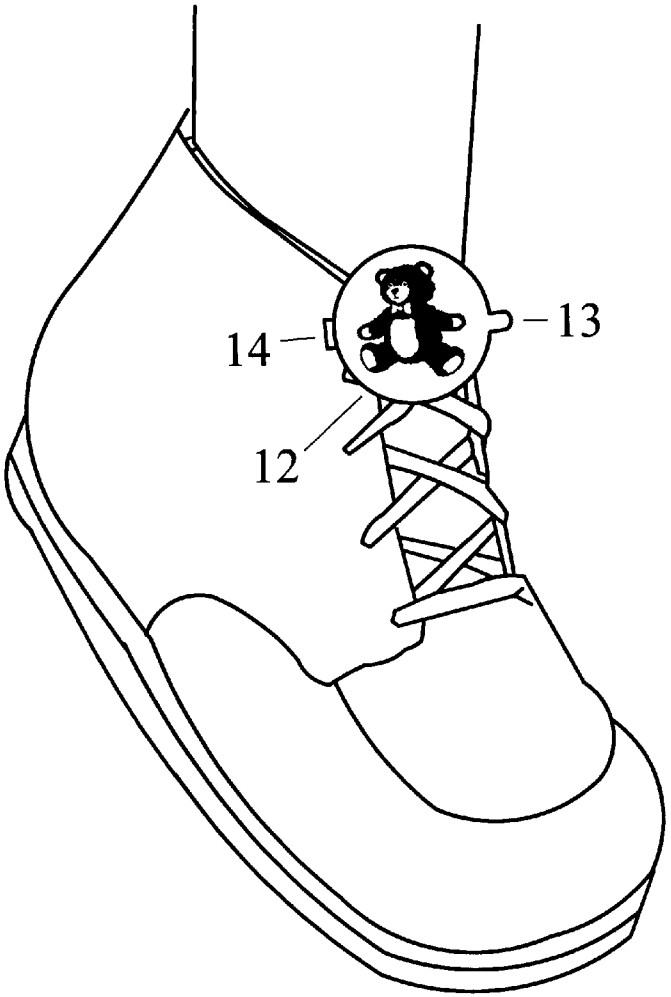
FIG. 4 illustrates the finished appearance atop the shoe, with the device closed and locked.

Installation: As shown in FIG. 2, the open device is slipped under the shoelace knot, between the knot and the shoe, using slot 11. The open device will then sit atop the shoe, with the knot and lace ends roughly fitting into well 10. The knot and lace ends are then placed completely into well 10, and cap 12 is then snapped over well 10.

Removal: Basically the reverse of installation, except that as a first step, cap 12 is rotated to line up indicator tab 14, and corresponding projecting tab 15, with slot 11. Cap 12 is then simply pulled off, in one quick, easy motion. The now-open device may then be slipped from between the knot and shoe. If cap 12 is not rotated to line up indicator tab 14 and corresponding projecting tab 15 with slot 11, projecting tab 15 will be retained by raised ridge 17, and cap 12 cannot be removed.

DESCRIPTION AND OPERATION—ALTERNATIVE EMBODIMENTS

Version With Well of a Curved Nature

Figure 7:
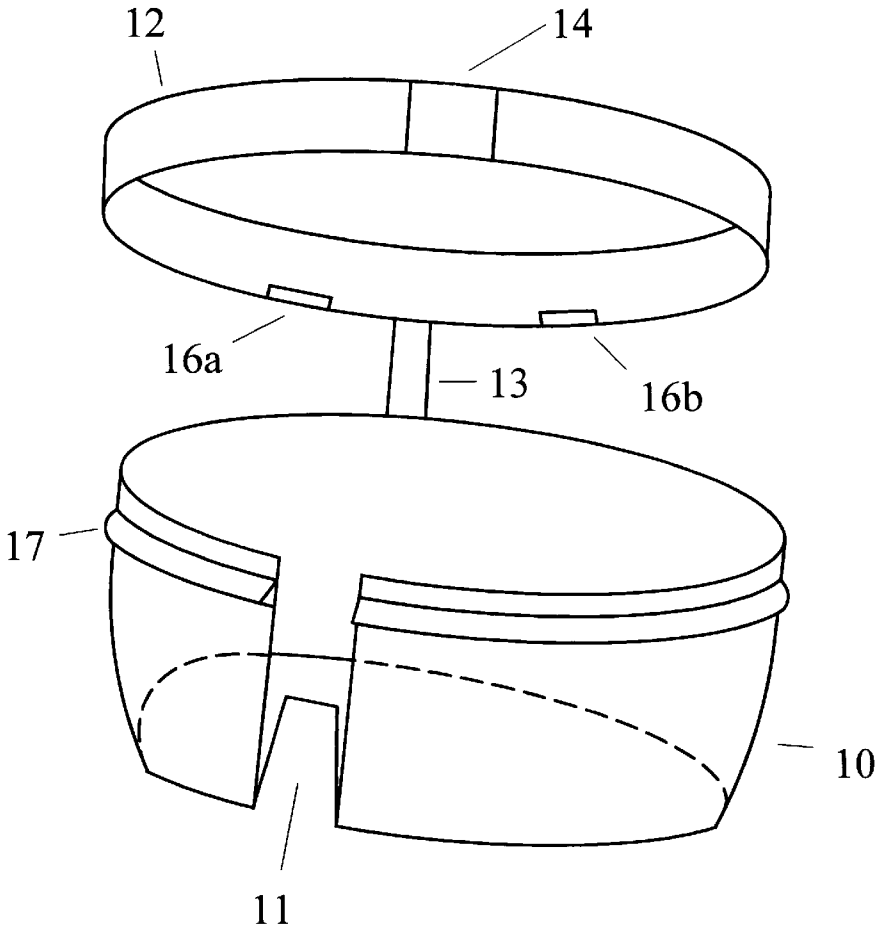
FIG. 7 illustrates an alternative embodiment—a version with a well of a curved nature, to facilitate slipping the device under the knot and lace ends.

FIG. 7 illustrates an alternative embodiment wherein well 10 is of a curved nature, to facilitate slipping the device under the knot and lace ends in a scooping motion. Other parts, as well as other operating steps, are the same as in the main embodiment.

Version With Notch at a Different Point Than Slot

Figure 8:
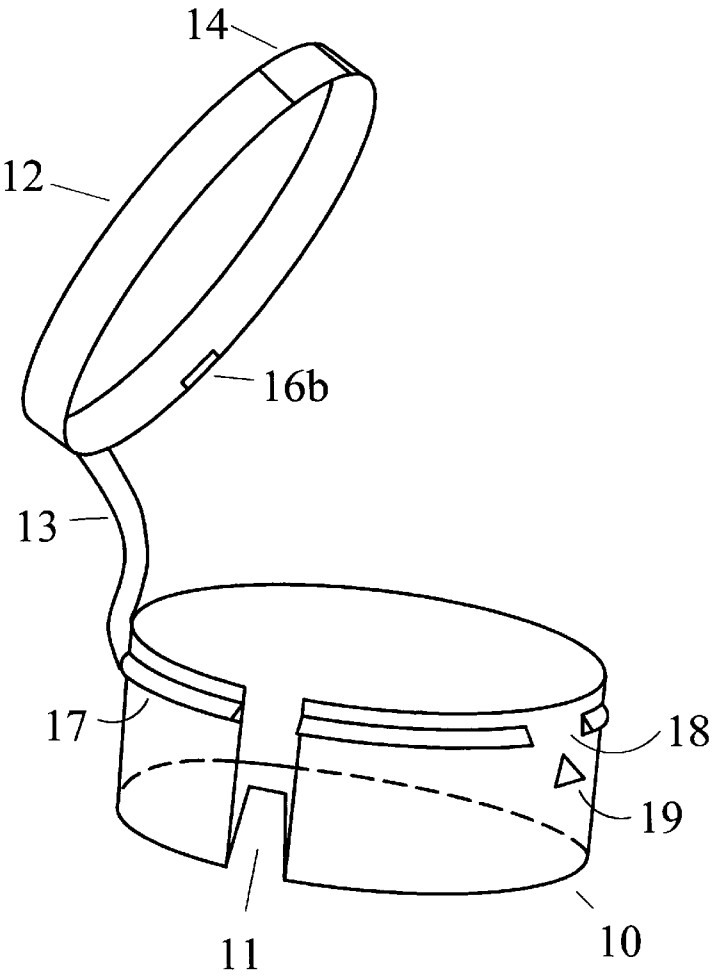
FIG. 8 illustrates an alternative embodiment—a version with the notch at a different point than the slot (slot doesn't also function as notch, as in the main embodiment).

FIG. 8 illustrates an alternative embodiment wherein a notch 18 is located in raised ridge 17 at a different point than slot 11. In other words, slot 11 does not also function as a notch to release cap 12, as in the main embodiment. A notch indicator 19, located on well 10 below notch 18, indicates the position of notch 18 when cap 12 is in the installed position. This allows cap 12 to be oriented differently on well 10 to facilitate installation and removal of cap 12, or to permit a different appearance. Other parts, as well as other operating steps, are the same as in the main embodiment.

Version With Slot Centered in Well

Figure 9:
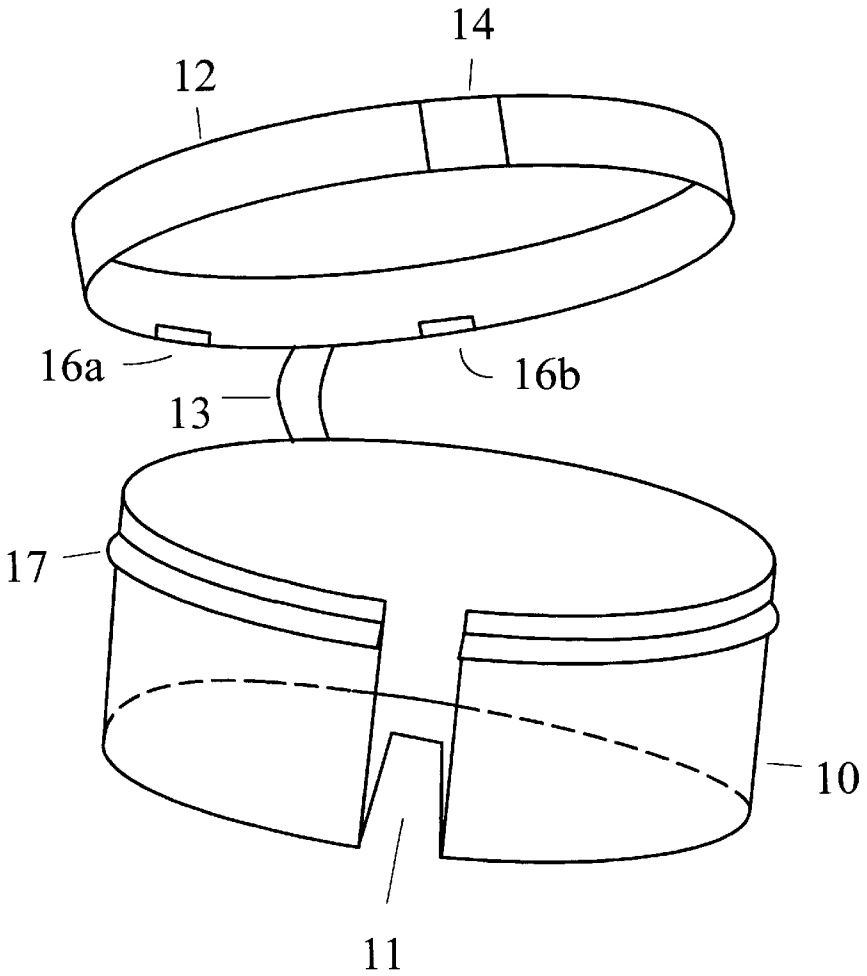
FIG. 9 illustrates an alternative embodiment—a version with a slot centered in the well, rather than offset.

FIG. 9 illustrates an alternative embodiment wherein slot 11 is centered in well 10, rather than located in an offset manner as in the main embodiment. A centered slot may facilitate the placement of the knot and lace ends into well 10; however, the upper part of well 10 will interfere somewhat with the upper areas of the shoe and foot. Other parts, as well as other operating steps, are the same as in the main embodiment.

Version With Two Slots

Figure 10:
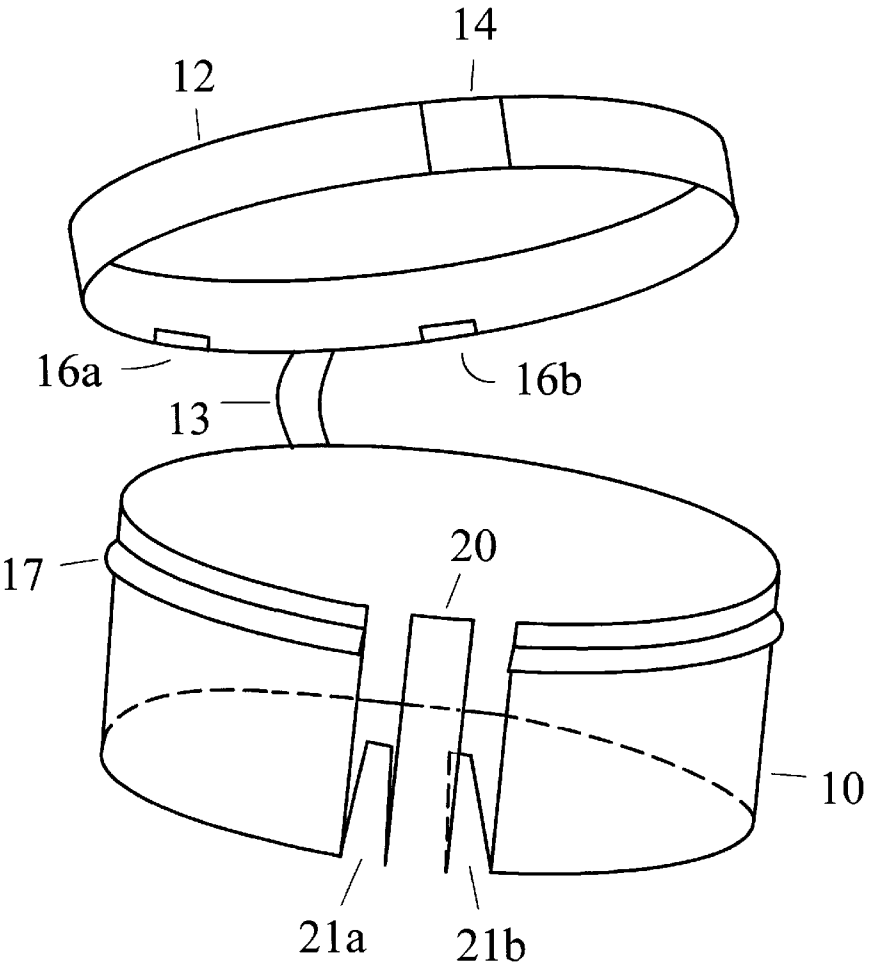
FIG. 10 illustrates an alternative embodiment—a version with two slots on either side of a central member.

FIG. 10 illustrates an alternative embodiment wherein two slots 21*a&b* are located on either side of a central member 20. This embodiment is inserted from the front or rear of the knot, rather than from the side as in the main embodiment. Each of the two laces fits one of slots 21*a&b,* and the knot fits over central member 20. Other parts, as well as other operating steps, are the same as in the main embodiment.

Version With a Shelf

Figure 11:
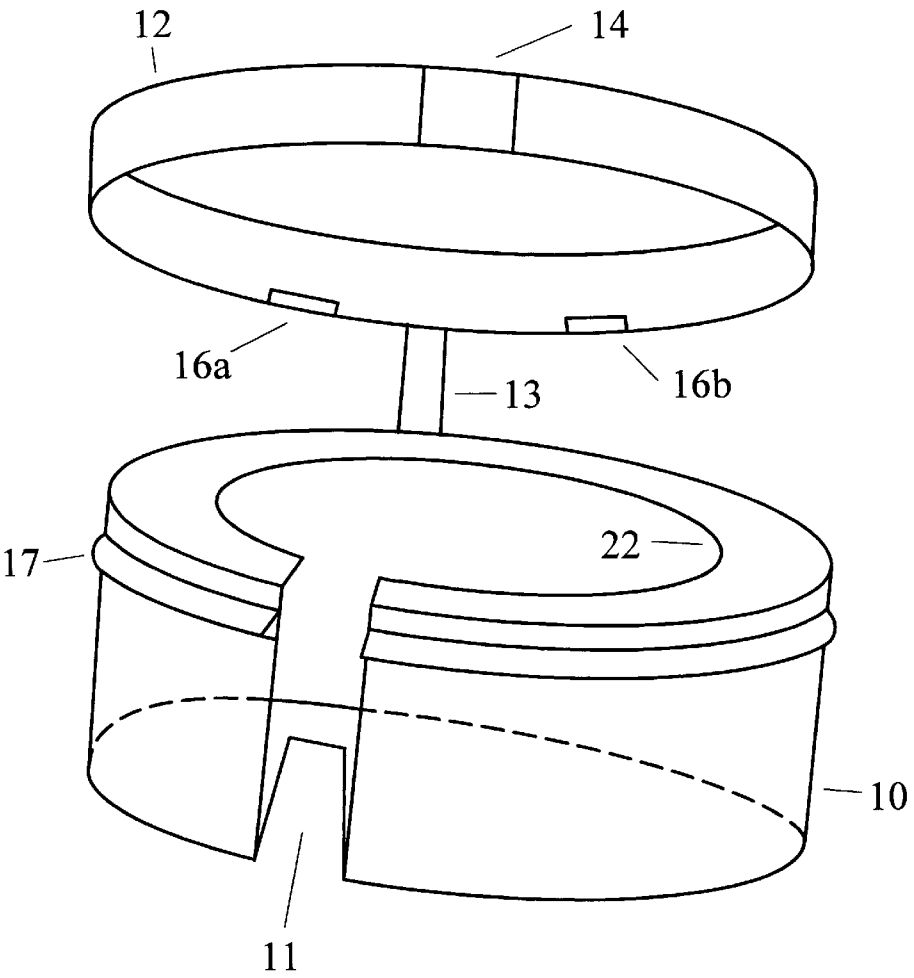
FIG. 11 illustrates an alternative embodiment—a version with a shelf to facilitate placing and containment of the knot and lace ends within the well.

FIG. 11 illustrates an alternative embodiment wherein a shelf 22 is located along the inner circumference of well 10, to facilitate the placing and containment of the knot and lace ends within well 10. Other parts, as well as other operating steps, are the same as in the main embodiment.

Version With Uniform Width Slot

Figure 12:
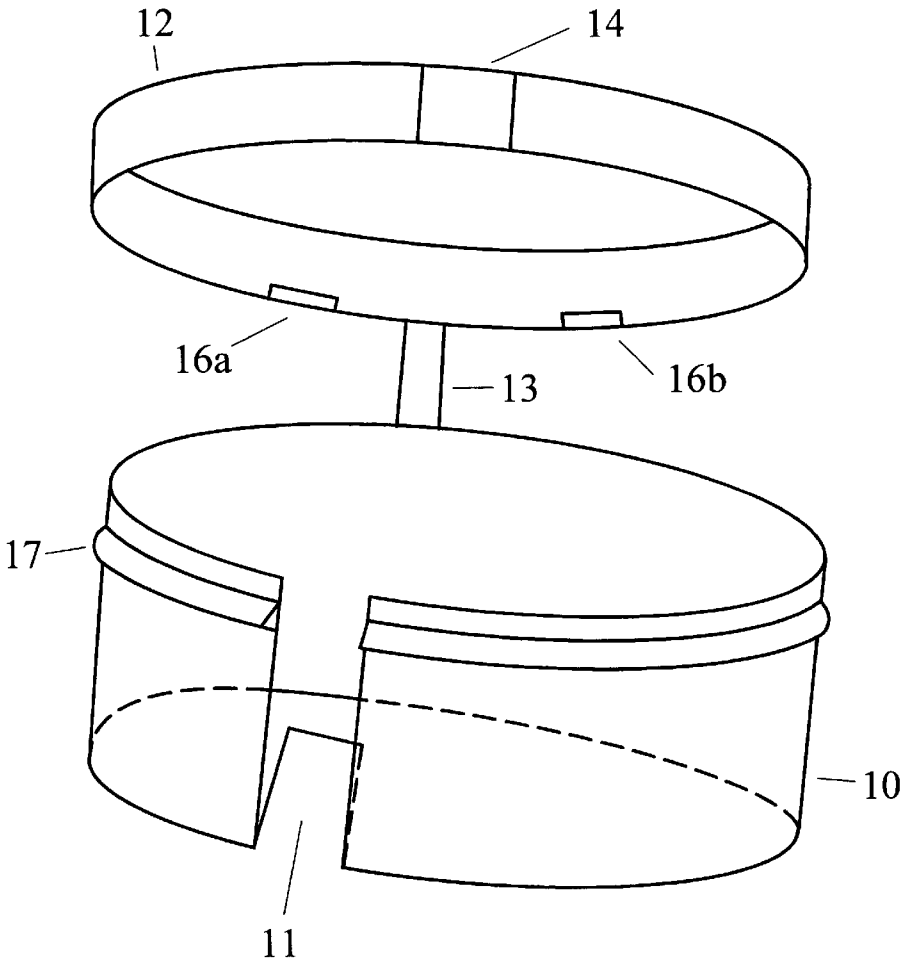
FIG. 12 illustrates an alternative embodiment—a version wherein the slot is of uniform width throughout its length, rather than narrowing as in the main embodiment.

FIG. 12 illustrates an alternative embodiment wherein slot 11 is of uniform width throughout its length, rather than narrowing as in the main embodiment. Other parts, as well as other operating steps, are the same as in the main embodiment.

These alternative embodiments illustrate features that are generally not independent of one another, but may be combined. As one example, the curved well embodiment shown in FIG. 7 may be combined with the uniform slot width embodiment shown in FIG. 12.

CONCLUSIONS, RAMIFICATIONS, AND SCOPE

Thus the reader will see that this invention is very effective at preventing toddlers from untying and removing their shoelaces, yet can be quickly and easily installed and removed by adults of any age, even those adults having reduced manual dexterity.

While my above description contains many specificities, these shall not be construed as limitations on the scope of the invention, but rather as an exemplification of one preferred embodiment thereof. Many other variations are possible. For example, Variations Shown As Alternative Embodiments As shown in FIG. 7, the main body of the device may have a curved nature, to facilitate slipping the device under the knot and lace ends.

As shown in FIG. 8, the notch may be located differently on the circumference of the raised ridge (slot doesn't also function as notch, as in the main embodiment). A notch indicator may be used, in this alternative embodiment, to indicate the position of the notch when the snap-fit cap is in place.

As shown in FIG. 9, the slot may be centered in the well, rather than offset. An offset slot, however, offers the advantage of an improved fit of the device on the shoe, by minimizing interference between the device and the upper areas of the shoe and foot.

As shown in FIG. 10, the main body may have two slots on either side of a central member. In this version, each of the two laces fit into one of the slots, with the knot fitting over the central member.

As shown in FIG. 11, a shelf may be added to facilitate placing and containment of the knot and lace ends.

As shown in FIG. 12, the slot may be of a uniform width throughout its length, rather than narrow as in the main embodiment. A narrowing slot, however, has the advantage of gripping the knot and laces more tightly and increasing the stability of the device atop the shoe.

Other Possible Variations, Not Shown As Alternative Embodiments

The indicator tab and projecting tabs may be located differently on the circumference of the snap-fit cap.

The indicator tab may be eliminated, to make the device more difficult for a child to comprehend and remove. In this variation, the strap attachment—point on the cap would indicate the position of the primary projecting tab an adult could easily comprehend and remember that the primary projecting tab is positioned directly opposite from the strap attachment point on the cap.

The strap may be located differently along the circumference of the well. The strap attachment point on the cap may also be different—for example, the strap could end in the center of the cap, which would increase the freedom of the cap to rotate when in an installed position atop the well.

The strap may be of a different shape—round, for example. This would increase the strap's resiliency, and thus increase the freedom of the cap to rotate when in an installed position atop the well.

The snap-fit cap may be attached to the main body with different means than the strap used in the main embodiment.

The offset slot can be located on either side of the well, to allow for installation of the device from either side of the knot. Slots on both sides of the well would also be possible, but could weaken the structural rigidity of the device.

The slot may be of different width, provided that it is wide enough to easily slip under the knot, yet narrow enough to retain the knot within the well.

The slot may be of different length, provided that it is long enough to permit the knot and lace ends to enter and be contained within the well.

The well may be of a different shape, as long as it has a round facet which can suitable engage the snap-fit cap.

The well and the snap-fit cap may have knurled outer surfaces, to improve a user's ability to grip the device.

The snap-fit cap may be of a different height/depth, as long as the raised ridge is also in a correspondingly different position. The cap may also be of a different shape—mounded, for example, or molded with a design—as long as it has a round facet which can suitably engage the well.

The device may be decorated with various designs that outwardly show when said device is closed and on the shoe.

The device may be manufactured in several pieces (the snap-fit cap may be unattached).

The device may be made out of many suitable materials. If made in several pieces, the pieces may be made of materials which differ from each other.

The device may be made in different sizes, as long as the well is large enough to suitably contain the knot and laces.

The device may be used anywhere the ends of laces, wire, rope, cord, chain, etc. need to be quickly and easily contained, for appearance or safety's sake.

Accordingly, the scope of the invention should be determined not by the embodiments illustrated, but by the appended claims and their legal equivalents.

I claim:

1. A device for containing a shoelace knot and lace ends, comprising:

(a) a well sufficiently large to contain said knot and lace ends, and (b) slotted means comprising at least one elongated slot incorporated into said well, extending from the interior to the perimeter of said well, and then extending vertically up the wall of said well, to form at least one opening in the top rim of said well, by which said knot and lace ends are introduced into said well, and (c) a snap-fit cap which engages and covers said well to contain said knot and lace ends, and which can be removed to uncover said well and replaced to cover said well, in order to remove said knot, whereby an adult can quickly and easily install or remove said device.

2. The device of claim 1, wherein said slot is of an offset nature, extending in a chordal manner from the interior to the perimeter of said well, whereby said knot is positioned in a non-centered manner within said well.

3. The device of claim 1, wherein said slotted means comprise two elongated slots incorporated into said well, separated by an elongated central member and extending from the interior to the perimeter of said well, and then extending vertically up the wall of said well, to form two openings in the top rim of said well, said openings separated by said central member.

4. The device of claim 1, wherein said slotted means are located on the left side of said well, extending from the interior to the perimeter of said well, and then extending vertically up the wall of said well.

5. The device of claim 1, wherein said slotted means are located on the right side of said well, extending from the interior to the perimeter of said well, and then extending vertically up the wall of said well.

6. The device of claim 1, wherein said slotted means are located on both sides of said well, extending from the interior to the perimeter of said well, and then extending vertically up the walls of said well.

7. The device of claim 1, wherein said slotted means narrow from the perimeter towards the interior of said well.

8. The device of claim 1, wherein said slotted means maintain a uniform width from the perimeter to the interior of said well.

9. The device of claim 1, wherein said cap can be rotated on said well to align a projecting tab located on the circumference of said cap with said slotted means, whereby installation and removal of said cap is facilitated.

10. The device of claim 1, wherein said cap can be rotated on said well to align a projecting tab located on the circumference of said cap with a notch in a raised ridge located on the circumference of said well, whereby installation and removal of said cap is facilitated.

11. The device of claim 1, wherein said well is of a curved nature, whereby introduction of said knot and lace ends into said well is facilitated.

12. The device of claim 1, wherein a shelf is located along the inner circumference of said well, extending toward the interior of said well, whereby placing and containment of said knot and lace ends within said well is facilitated.

13. The device of claim 1, wherein the construction is of a material selected from the group comprising acetal, polypropylene, and nylon.

14. The device of claim 1, wherein the construction is of one piece.

15. The device of claim 14, wherein said cap is attached to said well.

16. The device of claim 1, wherein the construction is of multiple pieces.

17. The device of claim 16, wherein said cap is separate and unattached to said well.

* * * * *